US009091517B1

(12) United States Patent
Perry, III

(10) Patent No.: US 9,091,517 B1
(45) Date of Patent: Jul. 28, 2015

(54) INSENSITIVE DETONATOR APPARATUS FOR INITIATING LARGE FAILURE DIAMETER EXPLOSIVES

(71) Applicant: LOS ALAMOS NATIONAL SECURITY, LLC, Los Alamos, NM (US)

(72) Inventor: William Leroy Perry, III, Los Alamos, NM (US)

(73) Assignee: LOS ALAMOS NATIONAL SECURITY, LLC, Los Alamos, NM (US)

( * ) Notice: Subject to any disclaimer, the term of this patent is extended or adjusted under 35 U.S.C. 154(b) by 0 days.

(21) Appl. No.: 13/722,612

(22) Filed: Dec. 20, 2012

(51) Int. Cl.

| | |
|---|---|
| ***C06C 7/00*** | (2006.01) |
| ***F42C 19/00*** | (2006.01) |
| ***F42C 19/08*** | (2006.01) |
| ***F42B 3/10*** | (2006.01) |
| ***F42B 3/113*** | (2006.01) |
| ***F42D 1/04*** | (2006.01) |

(52) U.S. Cl.
CPC . *F42C 19/00* (2013.01); *C06C 7/00* (2013.01); *F42B 3/113* (2013.01); *F42C 19/08* (2013.01); *F42C 19/0803* (2013.01); *F42C 19/0807* (2013.01); *F42B 3/10* (2013.01); *F42C 19/0823* (2013.01); *F42C 19/0838* (2013.01); *F42D 1/04* (2013.01)

(58) Field of Classification Search
CPC ..... C06C 7/00; F42B 3/10; F42B 3/18; F42B 3/113; F42C 19/00; F42C 19/08; F42C 19/0807; F42C 19/0803; F42C 19/0811; F42C 19/0823; F42C 19/0838; F42D 1/04
USPC ..... 102/200, 201, 202, 202.1, 205, 221, 102/396, 424, 427, 473, 481, 499, 293
See application file for complete search history.

(56) References Cited

U.S. PATENT DOCUMENTS

| | | | | |
|---|---|---|---|---|
| 6,591,753 | B1 * | 7/2003 | Schmid et al. | 102/205 |
| 8,065,959 | B1 * | 11/2011 | Shulte | 102/473 |
| 8,104,406 | B1 * | 1/2012 | Shulte | 102/473 |
| 8,387,534 | B1 * | 3/2013 | Imholt | 102/275.11 |

(Continued)

OTHER PUBLICATIONS

Glover, et al., "Microwave Properties of TATB Particles from Measurements of the Effective Permittivity of TATB Powders," Propellants Explos. Pyrotech. 34:347-350, (2009).

(Continued)

*Primary Examiner* — James S Bergin
(74) *Attorney, Agent, or Firm* — Ryan B. Kennedy

(57) ABSTRACT

A munition according to a preferred embodiment can include a detonator system having a detonator that is selectively coupled to a microwave source that functions to selectively prime, activate, initiate, and/or sensitize an insensitive explosive material for detonation. The preferred detonator can include an explosive cavity having a barrier within which an insensitive explosive material is disposed and a waveguide coupled to the explosive cavity. The preferred system can further include a microwave source coupled to the waveguide such that microwaves enter the explosive cavity and impinge on the insensitive explosive material to sensitize the explosive material for detonation. In use the preferred embodiments permit the deployment and use of munitions that are maintained in an insensitive state until the actual time of use, thereby substantially preventing unauthorized or unintended detonation thereof.

20 Claims, 3 Drawing Sheets

(56) References Cited

U.S. PATENT DOCUMENTS

| | | | | |
|---|---|---|---|---|
| 2006/0011083 | A1* | 1/2006 | Perry et al. | 102/205 |
| 2010/0089271 | A1* | 4/2010 | Colclough et al. | 102/473 |
| 2012/0123182 | A1* | 5/2012 | Krishna et al. | 600/1 |
| 2014/0013982 | A1* | 1/2014 | Meir et al. | 102/205 |

OTHER PUBLICATIONS

Hasue, et al., "Initiation of Some Energetic Materials by Microwave Heating," Propellants, Explosives, Pyrotechnics, 15:181-186, (1990).

Perry, et al., "Electromagnetically induced localized ignition in secondary high explosives," Journal of Applied Physics, 104:094906-1-0949-6-6, (2008).

Perry, et al., "Electromagnetically induced localized ignition in secondary high explosives: Experiments and numerical verification," Journal of Applied Physics, 110:034902-1-034902-8, (2011).

Urtiew, et al., "Effect of Confinement and Thermal Cycling on the Shock Initiation of LX-17," Combustion and Flame, 105:43-53, (1996).

Urtiew, et al., "Shock Initiation of Energetic Materials at Different Initial Temperatures (Review)," Combustion, Explosion, and Shock Waves, 41(6):766-776, (2005).

* cited by examiner

INSENSITIVE DETONATOR APPARATUS FOR INITIATING LARGE FAILURE DIAMETER EXPLOSIVES

STATEMENT REGARDING FEDERAL RIGHTS

This invention was made with government support under Contract No. DE-AC52-06NA25396, awarded by the U.S. Department of Energy to Los Alamos National Security, LLC for the operation of the Los Alamos National Laboratory. The government has certain rights in the invention.

BACKGROUND

Safety advances in the development of explosive materials have led to the widespread use of Insensitive Munitions (IM). The bulk of IM research efforts have concentrated on developing main charge materials that meet specific United States Department of Defense (DOD) and NATO requirements for threats by shape charge jet, fragment and bullet impact, slow and fast cookoff and sympathetic detonation. Relatively less attention has been given to initiation and booster systems. While the use of an IM main charge significantly reduces the probability of unintended initiation, there is a still a need in the art to improve the safety and insensitivity of the initiation and booster systems, particularly those used in initiating large failure diameter main charge systems.

SUMMARY OF THE PRESENT INVENTION

Aspects of the present invention provide a means to initiate extremely insensitive, large failure diameter explosive devices with the minimal or no use of normal sensitivity initiating components. As described in detail below, preferred embodiments of the present invention employ a relatively large output explosive charge that, under conditions of a majority of its lifecycle, has sensitivity characteristics sufficient to meet the Insensitive Munitions criteria. As such, the vulnerability presented by the currently used large normal sensitivity booster charges is eliminated for most of its life cycle until the point of actual use. At or near the point of use, a short burst of microwave energy can be applied to the detonator to increase the sensitivity of the insensitive explosive, either permanently or temporarily, to a point where it will function under the application of an initiation stimulus.

Various objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE PREFERRED EMBODIMENTS

As a person skilled in the art will recognize from the following detailed description and from the figures and claims, modifications and changes can be made to the preferred embodiments of the invention without departing from the scope of this invention defined in the following claims. The following description relates generally to a detonator device, a detonator system, and a full munition including the detonator device and/or the detonator system. The preferred embodiments described below provide numerous benefits in the safety, transportation, handling and use of explosive devices. In particular, the preferred embodiments provide for the development of munitions or armaments comprising only insensitive explosive materials, thus greatly diminishing the possibility of accidental or unauthorized detonation. Furthermore, the preferred embodiments provide for an additional safety mechanism that prevents unauthorized and/or unintended use of a munition without proper arming or sensitizing of the detonator. Other features, advantages, and benefits of the preferred embodiments of the present invention are described below.

Figure 1:
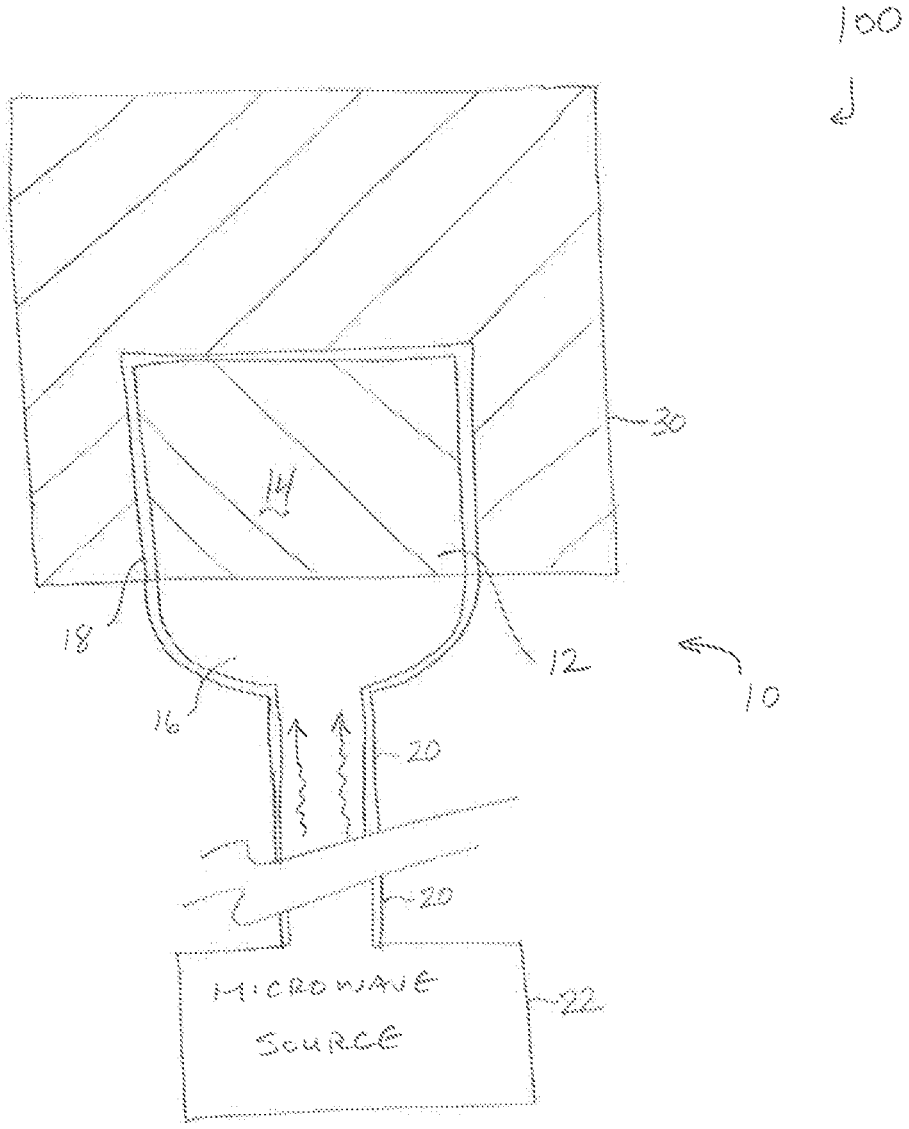
FIG. 1 is a schematic cross-sectional diagram of a detonator system in accordance with a preferred embodiment of the present invention.

As shown in FIG. 1, a detonator system 100 according to a preferred embodiment can include a detonator 10, described in detail below, which is selectively coupled to a microwave source 22 that functions to selectively prime, activate, initiate, and/or sensitize an insensitive explosive material for detonation. The detonator 10 can include an explosive cavity 12 having a barrier 18 within which an insensitive explosive material 14 is disposed and a waveguide 20 coupled to the explosive cavity 12. The preferred system 100 can further include a microwave source 22 coupled to the waveguide 20 such that microwaves enter the explosive cavity 12 and impinge on the insensitive explosive material 14 to sensitize the explosive material for detonation. In additional variations of the preferred system 100 described below, the system 100 can also include a waveguide cavity 16 connected to the explosive cavity 14. Suitable shapes and configurations of the explosive cavity 14 and the waveguide cavity 16 are described below in detail. Preferably, the detonator system 100 functions to selectively control the relative sensitivity of the detonator 10 in order to prevent inadvertent detonation of the insensitive explosive material 14 and/or any secondary explosive material 30 or munitions 80 to which the detonator 10 is attached. In particular, the preferred system 100 functions to maintain the insensitivity of the detonator 10 until the insensitive explosive material 14 is sensitized. Absent any sensitizing radiation, the insensitive explosive material 14, the detonator 10, and the detonator system 100 will preferably remain indefinitely in a safe and easy to handle state consistent with the Insensitive Munition parameters.

As shown in FIG. 1, in one variation of the preferred system 100 the explosive cavity 12 can be configured and/or shaped as a resonant cavity that defines a mode structure that is tuned to a predetermined microwave frequency. Preferably, the barrier 18 can function to define an outside portion and/or boundary of the explosive cavity 12 thereby defining the resonant aspects of the explosive cavity 12 relative to the pertinent microwave frequency. The barrier 18 can preferably be a reflective material that functions to substantially reflect incident microwaves back into a predetermined portion of the insensitive explosive material 14. Preferably, the barrier 18 material is chemically inert relative to the insensitive explosive material 14. Suitable barrier 18 materials can include for example metal foils, ceramics, polymers, or any suitable combination thereof. The explosive cavity 12 can be configured as any suitable geometry or volume, including for example a substantially cylindrical volume, a substantially hemispherical volume, a substantially polygonal volume, a substantially conical volume, and/or any other suitable geometry or resonant structure that functions to focus, reflect, resonate, and/or stimulate the interaction of the incident microwaves with the insensitive explosive material 14.

In another variation of the preferred system 100, the explosive cavity 12 can be configured and/or shaped such that the insensitive explosive material 14 material substantially adjoins the barrier 18 as shown in FIG. 1. Alternatively, the explosive cavity 12 can include another buffer material (not shown) disposed between the insensitive explosive material 14 and the barrier 18. Suitable buffer materials can include for example inert gases, liquids, or solids; foams such as polystyrene; another type or selection of insensitive explosive material 14; optically transparent materials such as polycarbonate or glass; or any combination thereof. Alternatively, the insensitive explosive material 14 can be separated from the barrier 18 in part by an air gap, or by one or more of the above-mentioned buffer materials in combination with an air gap. In another alternative configuration, the insensitive explosive material 14 can be graded or varied along any suitable direction relative to the barrier 18. For example, the insensitive explosive material 14 can be graded by density or volume such that it is more/less dense or more/less voluminous in a particular focusing region of the explosive cavity 12. In still other alternative embodiments, the insensitive explosive material 14 can be interwoven or embedded with other materials (e.g., one or more buffer materials) in order to manage, increase, and/or optimize the in/sensitivity, shape, volume, or explosive yield of the detonator 10.

In another variation of the preferred system 100, the microwave source 22 can be configured to emit microwave radiation at a predetermined energy, at a predetermined frequency, and/or for a predetermined interval. In one alternative configuration of the preferred system 100, the microwave source 22 can be a substantially fixed, for example within an armory. Alternatively, the microwave source 22 can be configured in a substantially portable or hand-held manner such that a user in the field can selectively sensitize one or more munitions prior to use. The former example provides the benefit of centralizing and controlling the selective arming of one or more munitions, thereby preventing unauthorized or uncontrolled arming or detonation of munitions. The latter example provides the benefit of permitting the distribution of insensitive munitions that are only sensitized at or near the time of actual use, thereby preventing unauthorized or unintended detonation. In another example configuration, the microwave source 22 can be configured with a secure interface (e.g., a particular key and lock combination) that prevents activation of the detonation system 100 by unauthorized parties.

In another variation of the preferred system 100, the microwave source 22 is configured to operate at a predetermined energy range between fifty and five thousand joules. More preferably, the predetermined energy can range between one hundred and four hundred joules. In one example embodiment, the predetermined energy of the microwave source 22 is approximately two hundred fifty joules. Independent of the predetermined energy range or value, the predetermined time interval can be less than or substantially equal to five seconds. More preferably, the predetermined interval can be approximately one tenth of a second. In another variation of the preferred system 100, the microwave source 22 can be figured to produce microwave pulses of approximately two hundred fifty joules for approximately one tenth of a second, wherein the microwave frequency include one or more bands ranging across the entire microwave band (e.g., three hundred MHz to three hundred GHz) such that the microwave frequency need not be a single mode pulse. Alternatively, the microwave frequency generated at the microwave source 22 can be a single mode or narrow band pulse (e.g., 2.3 to 2.7 GHz) of a particular frequency to most efficiently sensitize the selected insensitive explosive material 14.

In another variation of the system 100 of the preferred embodiment, the microwave source 22 can be configured to emit microwave radiation that alters at least one of the morphology, the temperature, or the porosity of the insensitive explosive material 14. Preferably, the energy, frequency, and duration of the emitted pulse can be correlated to a dielectric constant of the insensitive explosive material 14 to promote a change in at least one of the morphology, temperature, or porosity therein. Any or all of the suggested changes can be either temporary or permanent. As an example, a heat-induced change in the porosity of the insensitive explosive material 14 can be reversed through cooling of the insensitive explosive material 14. Similarly, induced changed in the morphology of the insensitive explosive material 14 might be reversible through cooling inducing subsequent change in the chemical structure of the insensitive explosive material 14. Conversely, the microwave radiation can permanently change the gross shape and porosity of the insensitive explosive material 14 such that it is permanently sensitized and primed for detonation. The microwave radiation can also be used to permanently alter the morphology of the insensitive explosive material 14. Whether the changes in temperature, porosity and/or morphology of the insensitive explosive material 14 are temporary or permanent can be determined by any one or more of: the selected insensitive explosive material 14, the energy of the microwave radiation, the frequency of the microwave radiation, the duration of the microwave radiation pulse, the shape of the explosive cavity 12, the reflective properties of the barrier 18, and/or the presence or absence of any additional or buffer materials in the explosive cavity 12 that might affect the heating/cooling rates or effects on the insensitive explosive material 14. Changes in the temperature of the insensitive explosive material 14 can be temporary or semi-permanent, depending upon the heat dissipation characteristics of the insensitive explosive material 14, the explosive cavity 12, and/or any optional and/or filler materials disposed in the explosive cavity 12. For example, relatively efficient thermal conductive materials can lessen the duration of any induced temperature changes, while relatively efficient insulating materials can lengthen the duration of any temperature changes, which in turn can also affect the relative permanence of any porosity and/or morphology changes to the insensitive explosive material 14.

Figure 4:
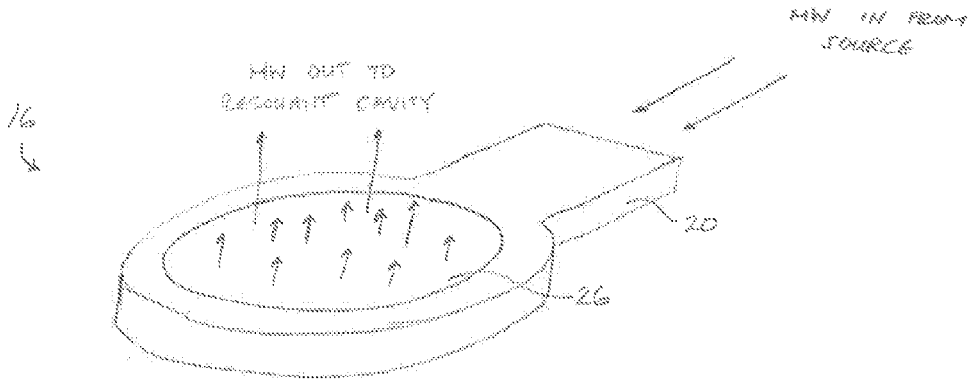
FIG. 4 is a perspective view of a preferred coupling usable in the detonator systems and detonator devices of the preferred embodiments.
Figure 5:
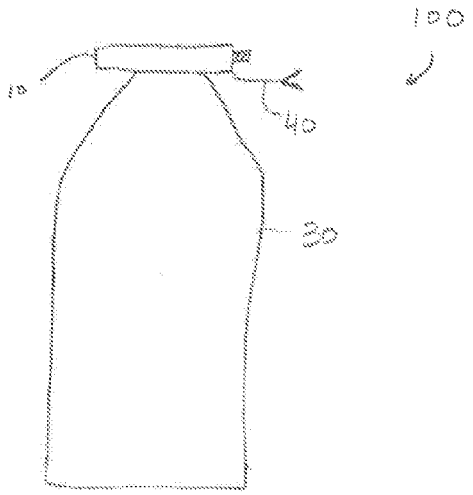
FIG. 5 is a plan view of a munition in accordance with a preferred embodiment of the present invention.
Figure 6:
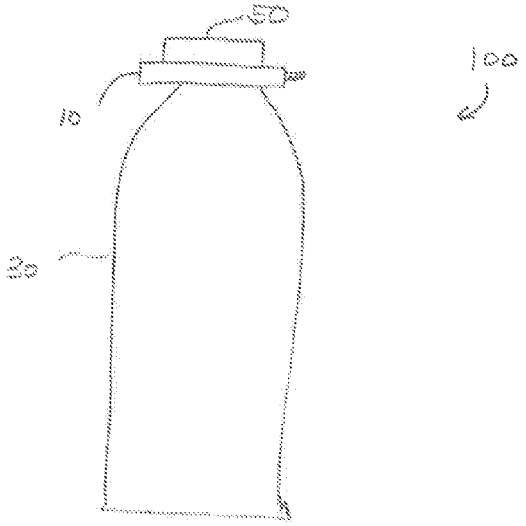
FIG. 6 is a plan view of another munition in accordance with another preferred embodiment of the present invention.

As shown in FIG. 4, in another variation of the system 100 of the preferred embodiment, the waveguide cavity 16 can be configured as a ring resonator 26. Preferably, the ring resonator 26 to optimally irradiate a volume of insensitive explosive material 14 in cooperation with the explosive cavity 12 and the barrier 18. In one particular implementation of the system 100, the ring resonator 26 can be coupled to a hemispherical volume of insensitive explosive material 14 to promote uniform heating thereof and thereby produce the desired changes (either permanent or temporary) in the porosity or morphology of the insensitive explosive material. In other variations of the preferred system 100, the ring resonator 26 can be coupled to any size, shape, or volume of insensitive explosive material 14, including cylindrical, conical, or polygonal volumes. Alternatively, the waveguide cavity 16 can be configured as any other suitable shape or geometry, including for example a cylindrical waveguide that can be coupled to any suitable shape or geometry of explosive cavity 14 as described below.

Figure 2:
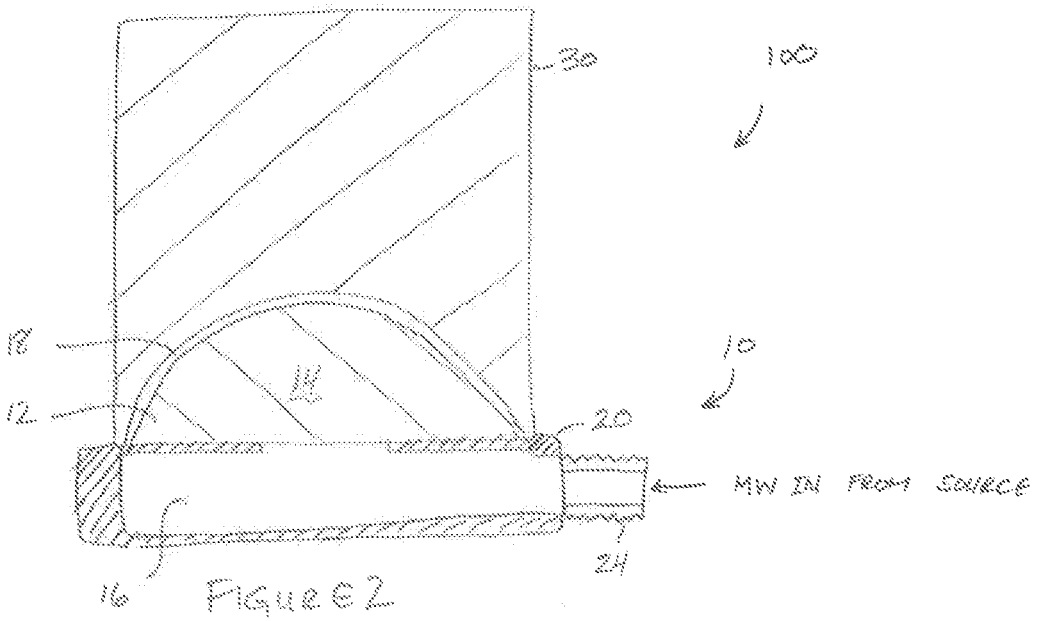
FIG. 2 is a schematic cross-sectional diagram of a detonator device in accordance with a preferred embodiment of the present invention.
Figure 3:
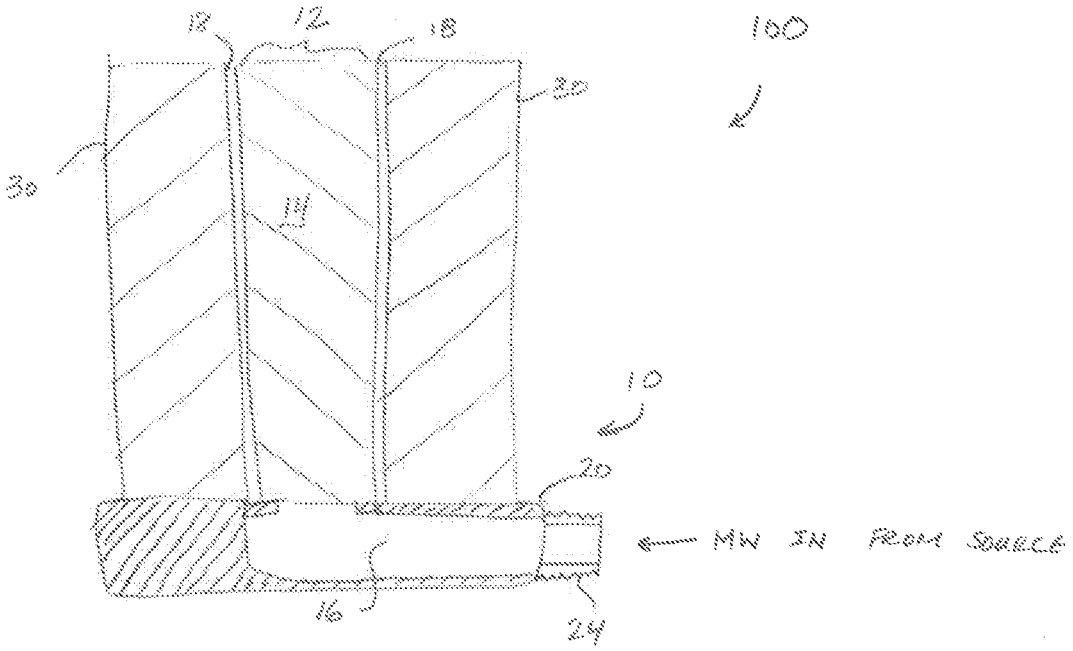
FIG. 3 is a schematic cross-sectional diagram of another detonator device in accordance with another preferred embodiment of the present invention.

As shown in FIGS. 2 and 3, variations of the preferred system 100 can include both hemispherical and cylindrical volumes of insensitive explosive material 14. In an additional variation of the preferred system 100, the waveguide cavity 16 can be coupled to the microwave source 22 by an optical coupling 24. A preferred waveguide 20 shown in FIGS. 1 and 4 can be of any suitable size, shape, or material; and the optical coupling 24 can be configured to receive any selected waveguide 20. Exemplary waveguides can include any one of a coaxial cable, cylindrical waveguide, a strip waveguide, or a rib waveguide. As noted above, in example implementations of the preferred system 100, the optical coupling 24 can include one or more safety mechanisms, locks, fail safes, or the like in order to prevent unauthorized or unintentional irradiation of the insensitive explosive material 14. The preferred waveguide 20 can alternatively or additionally include one or more of the safety mechanisms, locks, or fail safes to prevent unauthorized or unintentional optical coupling of the microwave source 22 to a detonator 10. In another example embodiment, the waveguide 20 and optical coupling 24 can include complementary safety mechanisms, locks, and/or fail safes to ensure a strict match between authorized uses of the microwave source and authorized arming of the detonator 10.

As shown in FIGS. 1, 2, 3, 5 and 6, the detonator 10 can be selectively connected to a second explosive material 30 that is part of a larger munition 80. Optionally, the detonator 10 can be inserted into and/or connected to the second explosive material 30, via a mounting bracket or threaded engagement for example, such that the detonator 10 and the second explosive material 30 can be kept in safe isolation until sensitizing or arming the detonator 10 is performed. In one preferred use, the detonator system 100 can further include a secondary detonator or initiator to detonate the sensitized detonator 10. Suitable initiators can include for example an exploding foil initiator 40, a laser initiator 50, low energy explosive device, or a high voltage exploding bridgewire detonator (not shown). Any other suitable secondary detonator or initiator that is configured for use with the insensitive explosive material 14 and/or the second explosive material 30 can be used in lieu of or in addition to any of the aforementioned initiators. Those of skill in the art will recognize that there are myriad combinations of the insensitive explosive materials 14, second explosive materials 30, and initiators 40, 50 that can be readily devised into a like number of munitions 80 having a variety of uses and/or applications in the civilian and defense arts.

In another variation of the preferred system 100, the microwave source 22 can be integrated into the munition 80 for selective activation, sensitizing, or arming of the detonator 10. As an example, the munition 80 can include a portable (single shot) microwave source 22 that can be activated by any suitable mechanism, for example by a secure communications protocol, to irradiate and sensitize the insensitive explosive material 14. For example, the detonator system 100, including the microwave source 22, can be embedded within a single munition 80 for deployment in any field of use. Until the microwave source 22 is activated, the munition 80 will be substantially inert and unable to properly detonate, thereby permitting its safe storage, transportation, and handling. At the time of use, the munition 80 can be armed by activating the microwave source 22, which in turn sensitizes the insensitive explosive material 14 and readies the detonator 30 for detonation as appropriate.

In additional variations of the preferred system ioo, the insensitive explosive material 14 can be selected from any suitable material, including but not limited to triaminotrinitrobenzene, 1,1-diamino-2,2-dinitroethene, PBX-9502, PBX-9503, LX-17-0, PBXW-14, diaminoazoxyfurazan (DAAF), 3,6-diamino-1,2,4,5-tetrazine-1,4-dioxide (LAX-112), FOX-7, or any suitable combination, mixture, or blend thereof. In a munition 80, the second explosive material 30 can also be selected from any suitable material, including but not limited to triaminotrinitrobenzene, 1,1-diamino-2,2-dinitroethene, PBX-9502, PBX-9503, LX-17-0, PBXW-14, DAAF, LAX-112, FOX-7, or any suitable combination, mixture, or blend thereof. The second explosive material 30 can additionally or alternatively include any other material, compound, or mixture that can be detonated, such as for example TNT, gunpowder, solid or liquid chemical fuels or propellants, pyrotechnics, other ballistics or armaments, and the like.

In another variation of the preferred system 100, the insensitive explosive material 14 can further include microwave absorber (not shown) to control the dielectric constant of the explosive. Preferably, the microwave absorber can include any one of graphite, graphene, carbon black, charcoal, carbon nanotubes, or silicon carbide. Alternatively, the microwave absorber can include any combination or mixture of any two or more of graphite, grapheme, carbon black, charcoal, carbon nanotubes, and/or silicon carbide. Preferably, the microwave absorber can be deposited, blended, mixed, pressed, casted, shaped, and/or formed onto, with, into, between, or integral with the insensitive explosive material 14 at the point of manufacture thereof. Alternatively, the microwave absorber can be deposited, blended, mixed, pressed, casted, shaped, and/or formed onto, with, into, between, or integral with the insensitive explosive material 14 at any other suitable juncture in the deployment, system integration, or activation of the preferred system 100.

The foregoing description of the preferred embodiments of the invention has been presented for purposes of illustration and description and is not intended to be exhaustive or to limit the claimed invention to the precise form disclosed. Those of skill in the art will readily appreciate that many modifications and variations to the claimed invention are possible in light of the above teaching. The preferred embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined exclusively by the following claims.

What is claimed is:

1. A detonator comprising:

a microwave cavity comprising a waveguide cavity and an explosive cavity;

an insensitive explosive material disposed within the explosive cavity;

an optical coupling connecting a waveguide to the waveguide cavity such that microwave radiation entering the waveguide cavity impinges upon the insensitive explosive material within the explosive cavity and sensitizes the insensitive explosive material for detonation; and an initiator connected to the insensitive explosive material.

2. The detonator of claim 1, wherein the explosive cavity is defined in part by a barrier separating the insensitive explosive material from a second insensitive explosive material.

3. The detonator of claim 2, wherein the barrier is a substantially reflective material.

4. The detonator of claim 1, wherein the explosive cavity is substantially hemispherical.

5. The detonator of claim 4, wherein the insensitive explosive material is substantially hemispherical.

6. The detonator of claim 5, wherein the waveguide cavity comprises a ring resonator.

7. The detonator of claim 1, wherein the explosive cavity comprises a resonant cavity comprising a well defined mode structure tuned to a predetermined microwave frequency.

8. The detonator of claim 1, wherein the explosive cavity is substantially cylindrical.

9. The detonator of claim 8, wherein the insensitive explosive material is substantially cylindrical.

10. The detonator of claim 1, wherein the insensitive explosive material comprises one of: triaminotrinitrobenzene, 1,1-diamino-2,2-dinitroethene, PBX-9502, PBX-9503, LX-17-0, PBXW-14, DAAF, NTO, LAX-112, or FOX-7.

11. The detonator of claim 1, wherein the waveguide comprises one of a coaxial cable, a cylindrical waveguide, a strip waveguide, or a rib waveguide.

12. The detonator of claim 1, wherein the initiator comprises an exploding foil initiator.

13. The detonator of claim 1, wherein the initiator comprises a laser initiator.

14. The detonator of claim 1, further comprising an exploding bridgewire detonator connected to the insensitive explosive material.

15. The detonator of claim 1, further comprising a low energy explosive device detonator connected to the insensitive explosive material.

16. The detonator of claim 1, further comprising a microwave absorber formulated with the insensitive explosive material to control the dielectric constant of the explosive.

17. The detonator of claim 16 where the microwave absorber comprises one of: graphite, graphene, carbon black, charcoal, carbon nanotubes, silicon carbide, or combinations thereof.

18. The detonator of claim 1, further comprising a mounting bracket to which a second insensitive explosive material is attachable to form a munition.

19. The detonator of claim 1, wherein the insensitive explosive material comprises triaminotrinitrobenzene.

20. The detonator of claim 1, wherein the insensitive explosive material comprises 1,1-diamino-2,2-dinitroethene.

* * * * *